US009403169B2

(12) United States Patent
Matteazzi

(10) Patent No.: US 9,403,169 B2
(45) Date of Patent: Aug. 2, 2016

(54) MECHANO-CHEMICAL REACTORS

(76) Inventor: Paolo Matteazzi, Treviso (IT)

( * ) Notice: Subject to any disclaimer, the term of this patent is extended or adjusted under 35 U.S.C. 154(b) by 459 days.

(21) Appl. No.: 13/996,673

(22) PCT Filed: Dec. 15, 2011

(86) PCT No.: PCT/IB2011/055708
§ 371 (c)(1),
(2), (4) Date: Jun. 21, 2013

(87) PCT Pub. No.: WO2012/085782
PCT Pub. Date: Jun. 28, 2012

(65) Prior Publication Data

US 2013/0284838 A1 Oct. 31, 2013

(30) Foreign Application Priority Data

Dec. 23, 2010 (IT) ..... TV2010A0168

(51) Int. Cl.
*B02C 17/06* (2006.01)
*B02C 17/14* (2006.01)

(52) U.S. Cl.
CPC ..... *B02C 17/06* (2013.01); *B02C 17/14* (2013.01)

(58) Field of Classification Search
CPC ..... B02C 17/06; B02C 17/14
USPC ..... 241/175
See application file for complete search history.

(56) References Cited

FOREIGN PATENT DOCUMENTS

| | | | |
|---|---|---|---|
| CN | 2877852 | Y | 3/2007 |
| CN | 201673081 | U | 12/2010 |
| EP | 0665770 | B1 | 1/1997 |
| EP | 0850700 | A2 | 7/1998 |
| EP | 1873190 | A1 | 1/2008 |

OTHER PUBLICATIONS

Sidor, J. "Mechanical Devices used for Production of Metallic, Ceramic-Metallic Alloys or Nano-Materials," Archieves of Metallurgy and Materials, vol. 52, Issue 3 (2007), pp. 407-414.
PCT International Search Report and Written Opinion dated May 31, 2012 for PCT/IB2011/055708, from which the instant application is based, 7 pgs.

*Primary Examiner* — Mark Rosenbaum
(74) *Attorney, Agent, or Firm* — Fredrikson & Byron, P.A.

(57) ABSTRACT

A mechano-chemical reactor comprising, driving means extended along one or more parallel axis, a mass made oscillating by the driving means along the direction of a vertical axis and an elastic system for a partial compensation of the inertial forces generated by the oscillating mass. The oscillating mass includes at least one restricted environment loaded with solid and/or liquid substances are loaded in order to be treated by the kinetic energy of milling bodies. The elastic system comprises flexible elements made of a titanium alloy which are either one-dimensional, i.e. a plurality of rectilinear parallel rods, or bi-dimensional, i.e. at least a polygonal plate having two sides parallel to the axis of the driving means. In rest conditions the flexible elements are extended substantially perpendicular to the direction of the oscillations of the mass.

15 Claims, 10 Drawing Sheets

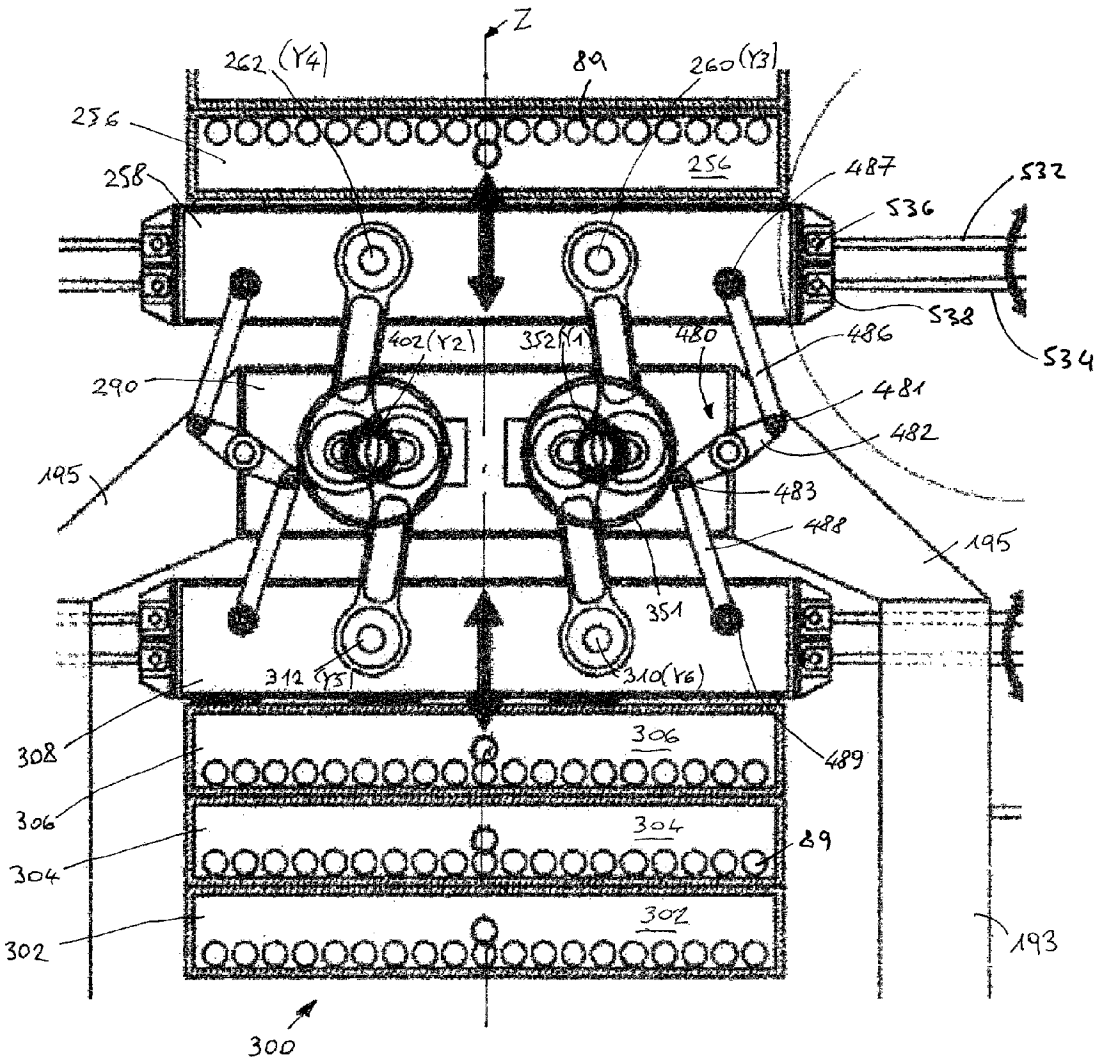
FIG. 8 bis

MECHANO-CHEMICAL REACTORS

RELATED APPLICATIONS

This application is a 35 U.S.C. 371 national stage filing from International Application No. PCT/IB2011/055708 filed Dec. 15, 2011, which claims priority to Italian Application No. TV2010A000168 filed Dec. 23, 2010, the teachings of which are incorporated herein by reference.

FIELD OF THE INVENTION

The present invention refers to a mechano-chemical reactor where the kinetic energy o milling means is used to submit substances in the solid and/or liquid state, loaded into a restricted environment, to a treatment able to modify their physical or chemical characteristics.

STATE OF THE ART

The utilization of so-called high energy mills is widespread, the mills making use of a kinetic energy of the milling means usually exceeding 400 W/dm$^3$ with the purpose of subjecting substances in the solid and/or liquid state to physical or chemical-physical treatments.

Primarily, though not exclusively, high energy mills are utilized in the nanotechnologies, namely in the production of nanomaterials which are at least partly formed by particles or granules typically of a size lower than 100 nanometer, namely lower than $10^{-7}$ meter. The article by J. Sidor, *Mechanical Devices for Production of metallic, ceramic-metallic alloys or nano-materials*, published in the *Archives of Metallurgy and Materials of the Polish Academy of Sciences*, no. 3/2007, is a synthetic presentation of several devices already utilized. As it can be ascertained from the data reproduced in some tables of this article, many of the present high energy mills have a low productivity so that their utilization other than in research laboratories or for a small industrial production (pilot production) is not suitable.

On the contrary, a high energy mill expressly designed for a high productivity (obviously at the date of the corresponding invention, that is according to the evaluations currently made in the early 90's) is disclosed in EP-A-0 665 770, the contents of which is herein incorporated for reference due to the fact that the author of the present invention was also one of the inventors of the mentioned patent. For the same reason, also herein incorporated for reference are the contents of EP-A-0 850 700 and EP-A-1 873 190 where several uses of said mill which, in the latter case, is a true reactor since it produces a treatment which is not only physical but also chemical.

Thus EP-A-0 665 770, which is deemed as the closest prior art of the present invention, discloses a high energy mill comprising a substantially cylindrical milling jar which, after being loaded with heavy balls or other grinding bodies and with a batch of the substances to be treated, is subjected by driving means to an alternate motion, namely to oscillations, along an axis corresponding substantially to the geometrical axis of the jar. When the mill is in operation, an elastic system provides a compensation of the inertial forces which are generated during the oscillations and have a sinusoidal-like behaviour.

In the cited prior art document only a few teachings are provided about the construction of the mill, anyhow from the description and the annexed drawings of the preferred embodiment it can be understood that the elastic system consists of a pair of cylindrical springs, namely of three dimension elements, which are in contact with the upper base and the lower base of the milling jar, respectively. The outer diameter of the springs does not substantially exceed the outer transversal dimensions of the jar, comprising the cooling mantle system. In order to increase the productivity the mill can adopt, instead of a single jar, multiple jars, i.e. constrained each other. Another document belonging to the state of art is CN 2 877 852 Y.

OBJECT OF THE INVENTION

Practical experience has shown that the commercial demand of nanomaterials which is continuously increasing quantitatively as well as qualitatively, cannot be technically and economically met by high energy mills as disclosed in EP-A-0 665 770.

Then, a first object of the present invention is to disclose a true mechano-chemical reactor which, when utilized in the nanotechnologies, is able to produce nanomaterials having chemical and chemical-physical properties modified with respect to the substances (raw materials) subject to treatment, such as: the state of chemical combination of the elements, the state of aggregation and the size of the crystals (when the substances are inorganic), the alloying and solid solution states, the mixing states of the different phases.

Another object of the invention is to disclose a reactor where the elastic system, adopted for the compensation of at least a share of inertial forces generated by the oscillating mass, is of a particularly robust and reliable design.

A further object is to disclose a reactor which, in at least an embodiment thereof, is able to be operated in a continuous mode, namely is able not only to treat the raw materials in separate batches but also able to operate in a continuous mode, i.e. able to treat indefinite amounts of substances in the solid and/or liquid state, thus attaining a very high productivity.

An additional object is to disclose a mechano-chemical reactor which is suitable for utilization in different industrial fields than nanotechnologies, for example in the general field of mixing and grinding various substances, in the chemical and metallurgical syntheses, in the production of liquids, even of a high viscosity with dispersions.

SUBJECT OF THE INVENTION

To reach the aims the subject of the present invention is a mechanical-chemical reactor comprising a mass oscillating substantially along one axis thanks to reciprocating driving means, the reactor being able to treat solid and/or liquid substances through the kinetic energy of milling bodies according to the features of the appended claims.

The novel features listed herebelow are deemed of a premium importance:

- two or more confined environments, where the milling means and the substances to be treated are loaded, are comprised in the oscillating mass which, in at least one embodiment of the invention, exceeds 700 kg;
- the oscillations of said mass have a frequency above 10 Hz, preferably 15 Hz, and an amplitude exceeding 20 mm, preferably 30 mm;
- the said confined environments consist either of an entire milling jar (called single jar from now onwards) or a plurality of chambers into which the jar (called multiple jar from now onwards) is subdivided through internal partitions; in the event the said chambers are suitable to be operated in parallel or also, with the use of proper connecting pipes, in series—with the result that the production of the reactor takes place in a continuous mode rather than by batches; the confined environments may also consist of a plurality of single or multiple jars in order to reach a particularly high productivity;

the elastic system, adopted for the compensation of at least a share of inertial forces generated by the oscillating mass, comprises a plurality of one dimensional or two dimensional flexible elements which are provided, in zones thereof which are spaced apart, only of hinging means or, alternatively, of hinging means and of rigid fastening means for the connection to the oscillating mass and/or to the structural frame of the reactor.

In the context of the present patent specification (description and claims) the expression "one dimensional or two dimensional" shall not be read in strictly geometrical terms but shall be considered as "prevailingly" one dimensional or two dimensional, i.e. "one dimensional" meaning that one dimension exceeds largely (by a factor of at least 2) the other two dimensions and, respectively, "two dimensional" meaning that two dimensions exceeds largely (each one by a factor of at least 1.5) the other dimension.

BRIEF DESCRIPTION OF THE DRAWINGS

For a better explanation of the features and the advantages of the present invention, the following description is of a few non limiting embodiments to which the attached drawings are referred:

FIG. 8*b* is shows a portion of FIG. 8 in an enlarged scale to enable a better view of the details of the driving means;

DESCRIPTION OF PREFERRED EMBODIMENTS

Figure 1:
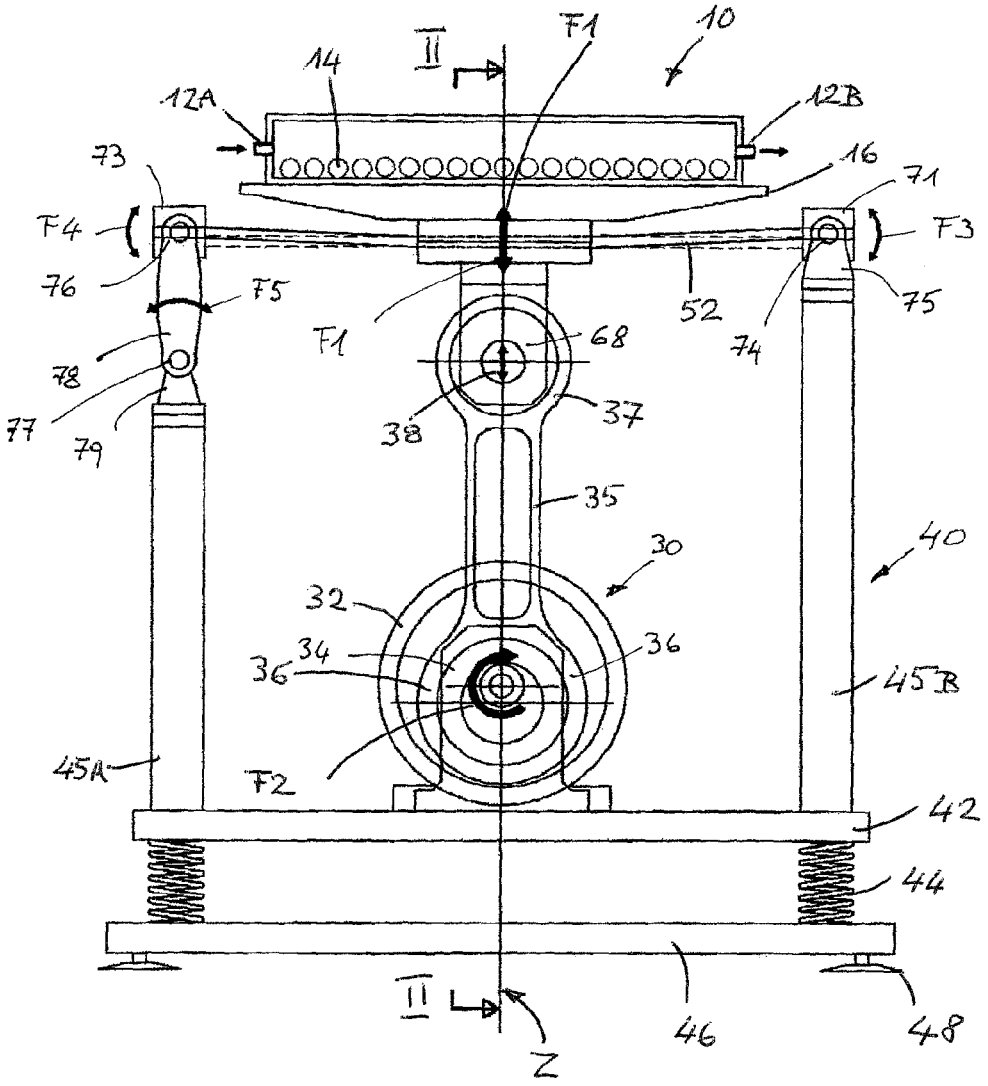
FIG. 1 shows a front view of a first embodiment where one single milling jar makes part of the oscillating mass of the reactor.
Figure 2:
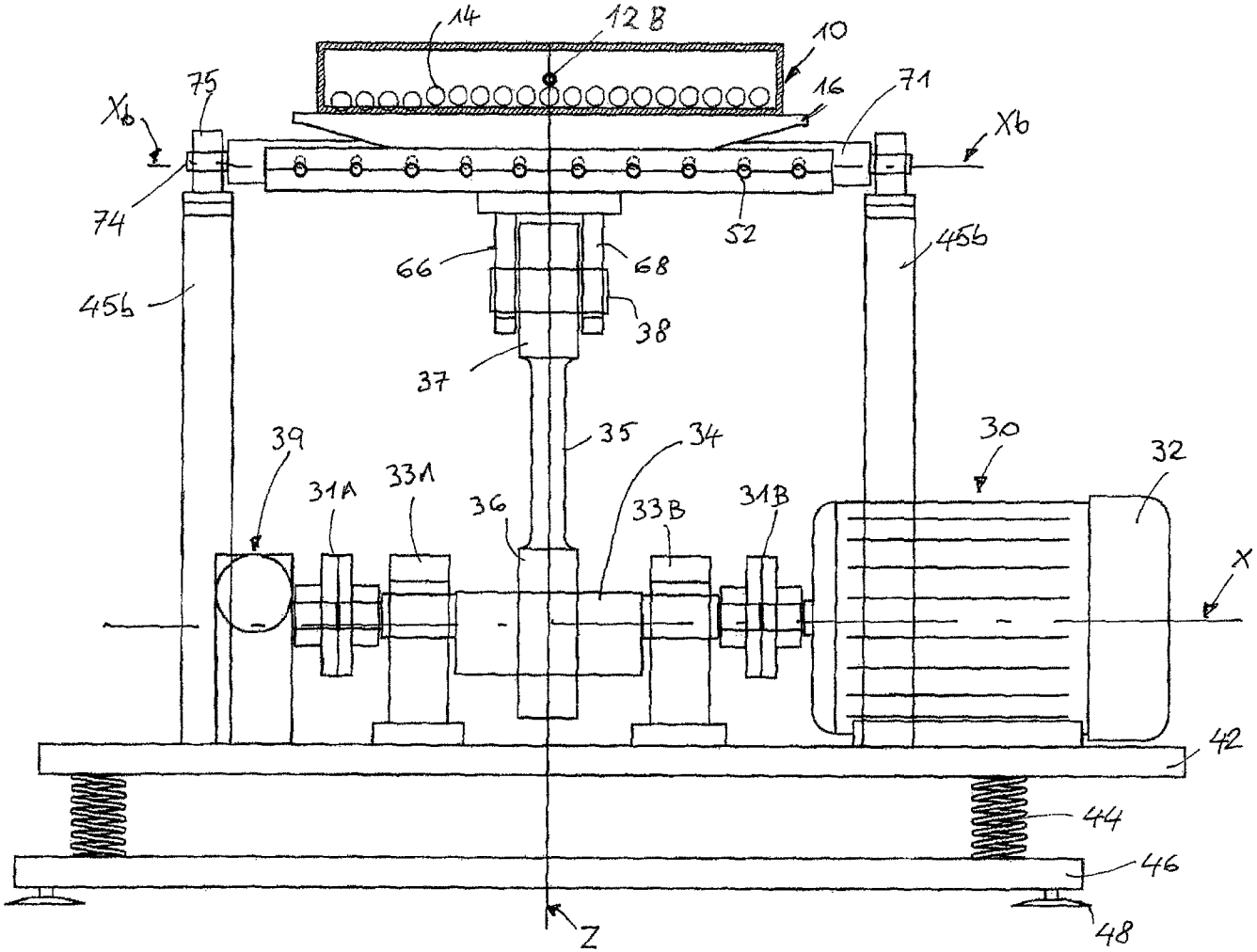
FIG. 2 shows a longitudinal cross-section along line II-II of FIG. 1.
Figure 4:
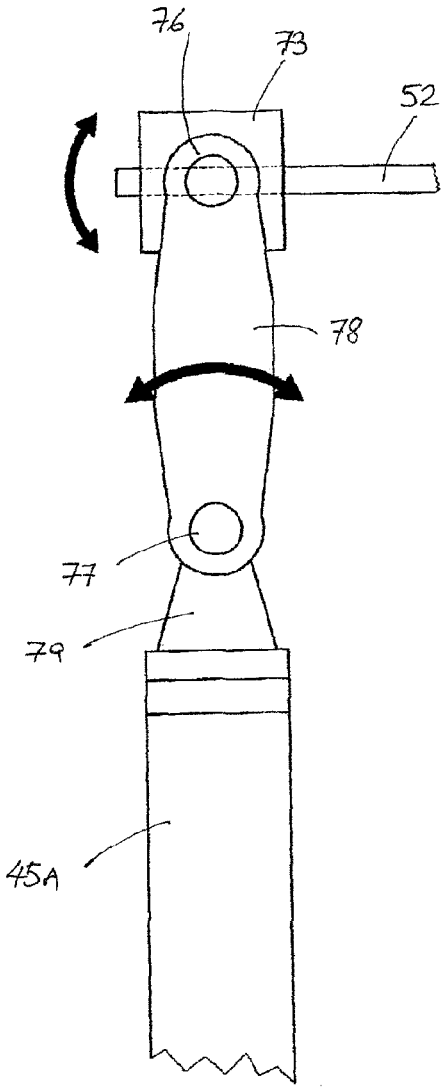
FIG. 4 shows in an enlarged scale the hinging means arranged at one end of the flexible element illustrated in FIG. 3 for the connection to the structural frame.

A first embodiment of the present invention, illustrated in FIGS. 1 and 2, is a reactor essentially comprising: a supporting frame; driving means mounted onto the supporting frame; a mass—of about 200 to 700 kg—which is oscillating due to the fact that it is subjected to a reciprocating motion substantially along one axis by the driving means; just one restricted environment—where substances to be treated and milling means are loaded—making part of the oscillating mass; an elastic system which, due to the fact of ensuring a non rigid link of the restricted environment to the supporting frame of the reactor, is able to compensate a majority share (at least 70%) of the inertial forces, having a sinusoidal-like behaviour, generated by the oscillating mass.

The structural frame 40 of the reactor comprises a first rigid pedestal 42, onto which the stationary components of a driving unit 30 are mounted, and a second rigid pedestal 46 resting on the floor through a plurality of spacing feet 48. A plurality of damping devices 44 are arranged between the pedestals 42 and 46. The supporting frame 40 also comprises a first pair 45A and a second pair 45B of columns, the latter being higher than the former. All the columns are projecting vertically from the first pedestal 42 to which are firmly fixed.

The simple jar 10, making part of the oscillating mass described in detail herebelow, is made of a wear resisting steel, e.g. Hardox®, and has the shape of a flattened cylinder with the axis Z arranged vertically and an enlarged basis 16. The introduction of the substances to be treated into the jar 10 and the discharge of the products resulting from the treatment take place through a pair of ports 12A and 12B respectively which are equipped with hermetic valves so as to make the jar a single restricted environment when the reactor is operated. A pair of parallel protrusions 66, 68 provided with coaxial holes (not shown) project downwards from the basis 16 of the jar 10. It is intended that the jar can also be of a non cylindrical shape but in any case its axis of oscillation Z is arranged vertically.

The jar is optionally equipped with ancillary devices such as heat exchangers, vacuum pumps etc, as well as with control devices, e.g. temperature and pressure sensors and vibration sensors (all the said devices being of a conventional construction, so they do not need to be here described in detail nor shown in the drawings). In this manner the treatment by the reactor of the substances loaded into the jar in the desired environmental conditions is ensured at the best.

Also loaded into the jar, with the substances to be treated, is a convenient amount of milling balls 14 (or milling bodies of a different shape) which are made of a material having a high resistance to corrosion and wear, e.g. chromium steel.

The reciprocating driving unit 30 is arranged along a horizontal axis X perpendicular to the axis of oscillation Z of the jar and comprises: a rotary electric motor 32—as shown by arrow F2 in FIG. 1—secured to the first pedestal 42. Through an elastic joint 31B rotor 32 drives an eccentric shaft 34, supported by a pair of bearings 33A and 33B, where the big end 36 of a connecting rod 35 is mounted. The small end 37 of the rod 35 is secured to the basis 16 of the jar 10 through a pin 38 passing through the coaxial holes of protrusions 66 and 68.

For this reason the jar 10, in the case equipped with the above mentioned ancillary and control devices and after it is loaded with the substances to be treated and with the milling bodies, with the small end 37 of the rod 35, are the parts of the entity which is defined as oscillating mass in the present text.

To ensure the start the motor 32 the driving unit 30 comprises a mechanical device 39 supported by the first pedestal 42 of the supporting frame 40 and connected to the shaft 34 through a second elastic joint 31A. The starting device 39 is of a conventional construction, thus it is not deemed as necessary to illustrate its details which include a hydraulic ram for the actuation of a rack coupled to a cogged wheel. Therefore, of the oscillating mass of the reactor, which in this first embodiment is of about 200 to 700 kg, make part the milling jar 10, including the above mentioned small end 37 of the rod 35. The oscillations, namely the reciprocating motion to which the jar 10 is subjected by the driving means, take place in the direction of the axis Z of the jar 10, as shown by the double arrow F1 in FIG. 1. As a consequence, the inertial forces generated by the oscillations have a sinusoidal-like behaviour.

According to the present invention, the elastic system which is able to compensate a majority share (at least 70%) of the inertial forces comprise a plurality of one dimensional or two dimensional flexible elements which, in the rest condition of the reactor, are extended perpendicular to the vertical direction Z of the reciprocating motion of the oscillating mass.

The one dimensional flexible elements are a plurality (for example ten) rectilinear flexible bars 52 made of a titanium alloy. In this first embodiment, as illustrated in FIGS. 1 to 4, the bars 52 have a circular cross-section and are made of $Ti_6Al_4V$, a titanium alloy Grade 5 having a low specific weight and excellent mechanical characteristics.

Figure 3:
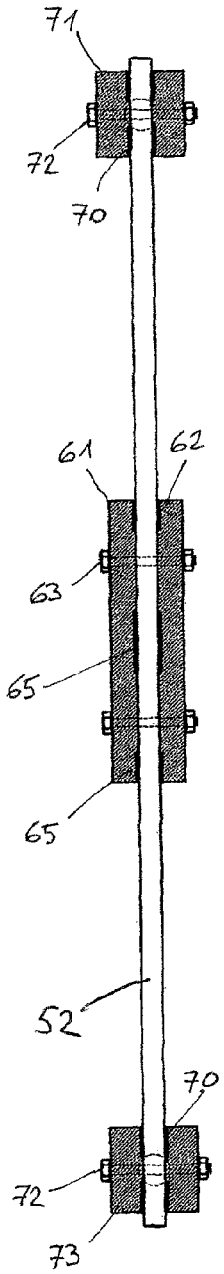
FIG. 3 shows in an enlarged scale one of the flexible element comprised in the elastic system of the reactor illustrated in the preceding figures.

As shown in FIG. 3, where a bar is seen in its longitudinal extension, the central portion of all bars 52 is clamped between a pair of thick rigid planes 61 and 62, which are superimposed and adequately grooved, with the interposition of protective bushes 65. The said plates are of a rectangular shape with their longer side extended parallel to the axis X of the driving unit 30. A plurality of vertically arranged bolts 63 passing through the plates 61, 62 and screwed into the base 16 of the jar 10 are consequently the rigid fastening means ensuring the connection of the bars 52, namely of the flexible one dimensional elements, to the oscillating mass.

At their end portions (respectively at the right and at the left in FIGS. 1 and 3, namely where they protrude from the base 16 of the jar 10, and spaced from one another, all the bars 52 are firmly retained in corresponding passing holes of a pair of parallelepiped rigid blocks 71, 73 by means of a plurality of vertically arranged bolts 72 and the interposition of protective bushes 70. The blocks 71, 73 are of a smaller width than the plates 61, 62—see FIGS. 1 and 3—and, in the same manner as said plates, are extended along corresponding horizontal axes Xa, Xb parallel to the axis X of the driving unit 30. A pair of pins 74, in the present context defined as first pins, are protruding from the heads of the first rigid block 71 along the axis Xb. The pins 74 are housed in corresponding bearings 75 secured to the top of the pair of columns 45B which are comprised in the supporting frame of the reactor, at the right side in FIG. 1. So, this is a first hinging means for the connections of the bars 52, namely of the one dimensional flexible elements of the elastic system to the supporting frame of the reactor.

In the same manner, another pair of pins 76, in the present context defined as second pins, are protruding from the heads of the second rigid block 73 along the axis Xa. The pins 76 are housed in an end of two arms 78 tilting on a vertical plane. At the second end of the tilting arms 78 are provided another pair of pins which are housed in corresponding bearings 79 secured to the top of the other pair of columns 45A which are comprised in the supporting frame of the reactor, at the left side in FIG. 1. The purpose of this peculiar construction of the second hinging means—for the connections of the bars 52, namely of the one dimensional flexible elements of the elastic system to the supporting frame of the reactor—is to face up to the approach of the opposed ends of the flexible bars 52 taking place at any reciprocating movement of the oscillating mass of the reactor.

It shall be considered that in FIG. 1 double arrow F3 shows the first hinging connection and arrow F4 the second hinging connection of the bars 52, namely of the one dimensional flexible elements of the elastic system to the structural frame while double arrow F5 shows the tilts of arms 78.

A variant (not illustrated in the drawings since it is easy to realize by a person skilled in the art on the basis of the preceding description) of this first embodiment comprises the utilization, instead of the rectilinear bars, of at least one flexible plate of a polygonal shape, namely at least one two dimensional element, in the construction of the elastic system of the reactor. In the rest condition of the reactor the at least one plate is extended perpendicular to the vertical direction Z of the reciprocating motion of the oscillating mass. A plurality of bolts, or equivalent fastening means, are provided at the central portion of the flexible plate to obtain a rigid connection of the elastic system to the base of the oscillating milling jar while hinging means are provided at two other portions of the flexible plate corresponding to a pair of parallel sides, namely at a pair of locations spaced apart from one another and also spaced from the central portion of the plate. The purpose of said hinging means is to ensure a hinging connection of the elastic system to the structural frame along a pair of axes parallel to the axis X of the driving unit.

Thanks to the above described features, when the reactor is in operation, the one dimensional (bars) respectively two dimensional (plate or plates) flexible elements of the elastic system are able to compensate a majority share of the inertial forces generated by the reciprocating movement of the oscillating mass and having a sinusoidal-like behaviour.

The vibrations of the reactor in its entirety, as well as a minority share of the inertial forces generated by the oscillating mass, are on the contrary scaricate toward the floor through the supporting frame, more precisely through the damping means 44 which are interposed between he first pedestal 42 and the second pedestal of the structural frame.

Figure 6:
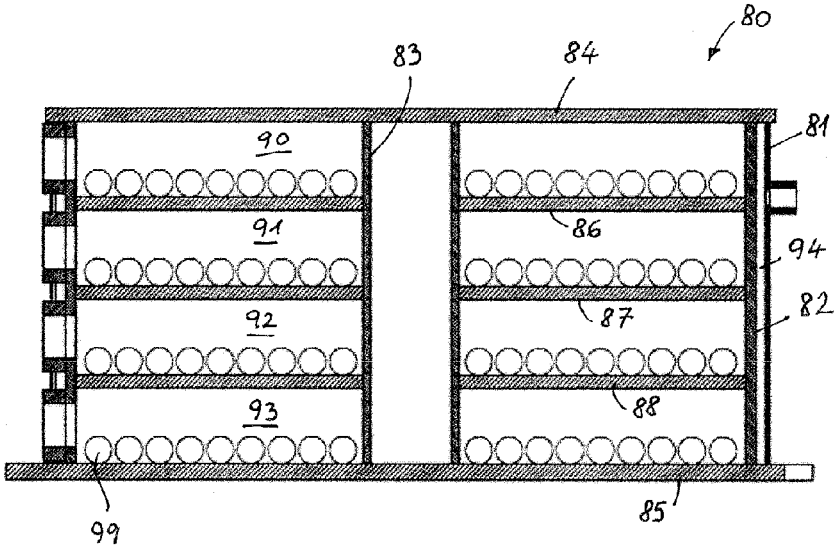
FIG. 6 is a cross-section of the multiple jar along line VI-VI of FIG. 5.
Figure 5:
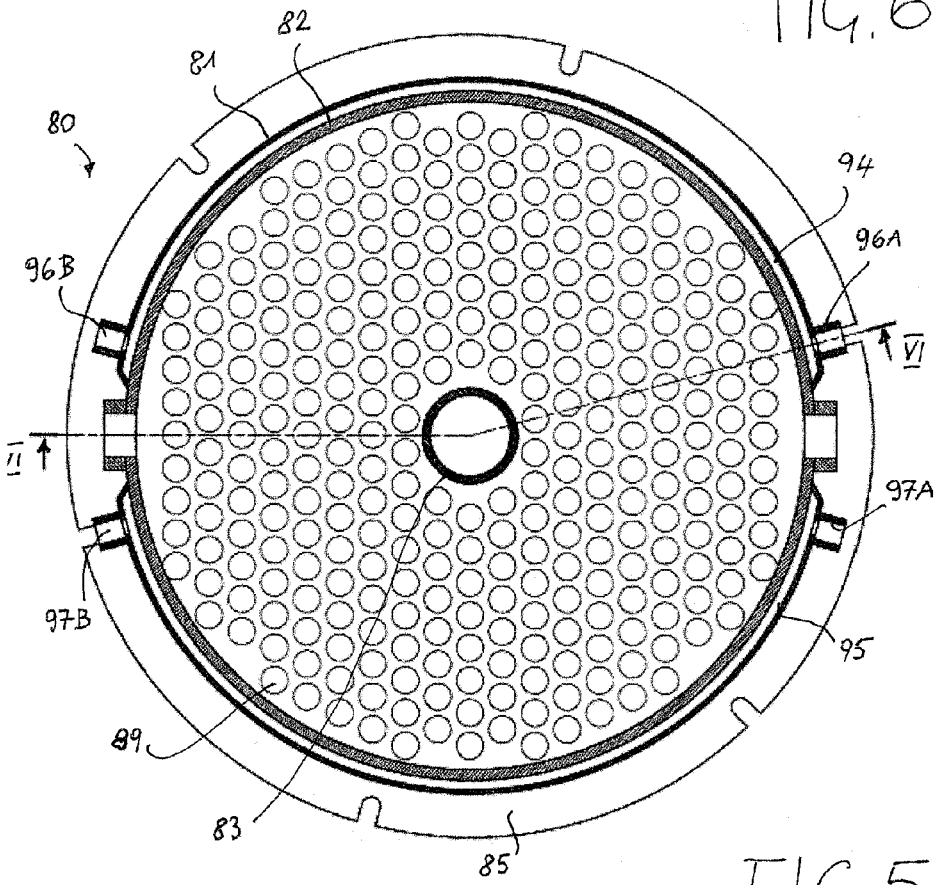
FIG. 5 shows a cross-sectioned top view of a multiple milling jar which can be used in the reactor illustrated in the preceding figures with the purpose of increasing its productivity, even when production of the reactor takes place in a continuous mode.
Figure 7:
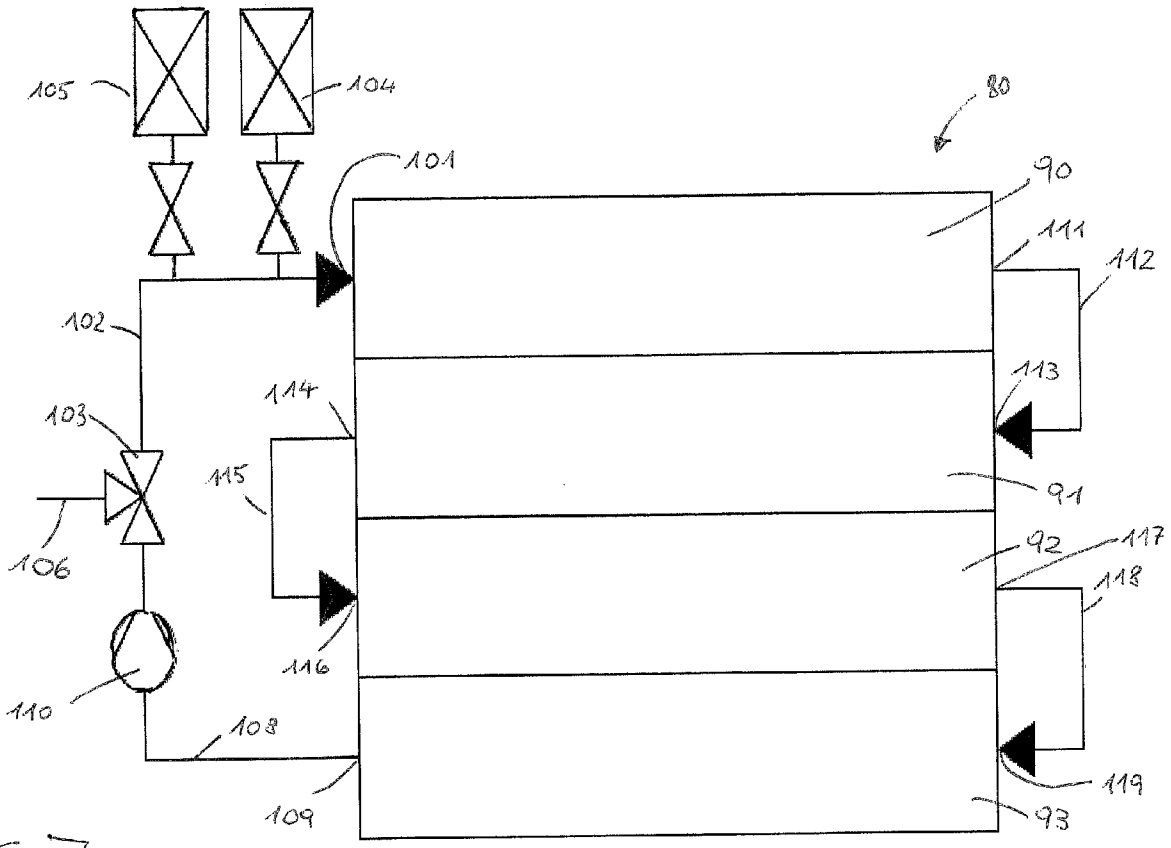
FIG. 7 is a schematic illustration of the multiple jar when production of the reactor takes place in a continuous mode.

While leaving unchanged the other features which were described in the preceding pages, instead of the single jar 10 the reactor can comprise what has above been called multiple jar, designated as a whole by the reference numeral 80 comprising a plurality of restricted environments where milling bodies 89 and solid and/or liquid substances to be treated are loaded—see FIGS. 5 to 7.

Also the multiple jar 80, which is made of a wear resistant steel, e.g. Hardox®, is of a cylindrical shape. It comprises: an upper base 84; a lower base 85, wider than the upper base 84; a cylindrical casing, welded to bases 84 and 85, formed by an outer wall 81 and an inner wall 82 thinner than the outer wall; a centrally aligned hub 83, which is in the form of a hollow cylinder welded to bases 84 and 85.

The walls 81 and 82 of the casing are separated from one another by two hollow spaces 94 and 95, each of them being half-cylindrical in shape, where a heating and/or cooling fluid is circulated. Inlet fittings 96A, 96B and outlet fittings 97A, 97B are provided on the hollow spaces for the purpose of filling and draining the fluid—see FIG. 5.

As already mentioned here above, while the single jar 10 illustrated in FIGS. 1 and 2 has just one restricted environment for treatment of the substances, the multiple jar 80 can comprise a plurality of such environments where milling spheres 99 and substances to be treated are introduced. In this embodiment the restricted environments consist of four chambers which are designated in FIG. 5 with reference numerals 90, 91, 92, 93 from top to the bottom of the jar 80.

The said chambers are obtained by three discs 86, 87, 88 which are welded to the hub 83 and to the inner wall 81 of the casing in a vertically spaced relationship.

It shall be understood that a multiple jar can also be of a non cylindrical shape and constructed in such a way to be subdivided into other than four chambers, for example made of materials with a high strength and a low specific weight or made of materials with a honeycomb structure. Thus a multiple jar may comprise five or more chambers or even only two or three chambers.

Each chamber of the multiple jar 80 is provided with two ports, for the inlet respectively outlet and with tubular fittings associated to valves in order to obtain various series and/or parallel connections between the chambers, consequently with different modes of operating the reactor as it will be explained here below.

A first mode of operation of the reactor is, so to say, 100% parallel and is realized when either said tubular fittings are missing or the mentioned valves are only open for the time needed to introduce into the jar the substances to be treated and the time needed for discharging from the jar the products resulting from the treatment. In this case each one of the chambers 90 to 93 is an independent restricted environment where the mechano-chemical processes are separated from one another although simultaneous. As a result the reactor is operated by batches, i.e. in a discontinuous mode, as in the preceding case of the single jar.

A second mode of operation of the multiple jar 80 is, so to say, 100% series with the result that the reactor is operated in a continuous mode. FIG. 7 refers to this mode. The substances to be treated, stored in tanks (not shown) and fed by in parallel through the solenoid valves 104, 105 are introduced into the first chamber 90 via a tubular fitting 102 and a one-way valve 101 positioned at the first port of the chamber 90. After a first partial treatment the substances are drained through the second port 111 of the first chamber 90 and transferred to the second chamber 91 through a tubular fitting 112 and a one-way valve 113 for a second partial treatment. At the end thereof the substances are drained through the second port 114 of the second chamber 91 and transferred to the third chamber 92 through a tubular fitting 115 and a one-way valve 116 for a third partial treatment. At the end of the third partial treatment the substances are drained through the second port 117 of the third chamber 92 and transferred to the fourth chamber 93 through a tubular fitting 118 and a one-way valve 119 for a further treatment. At last, the contents of the fourth chamber 93 is moved from the second port 109 along a tubular fitting 108 upstream of a pump 110 downstream of which is arranged a valve 103. If the treatment of the substances by the reactor is completed the valve moves the products resulting of the treatment to an external storage container (not shown) through a tubular fitting 106. On the contrary, if the treatment of the substances by the reactor needs to be continued the valve 103 moves the substances to the first tubular fitting 102 for a repetition of the operation now described.

Of course a batch of substances to be treated can be replaced by a second batch as soon as the treatment in a chamber of the multiple jar is completed with the result of a continuous mode of operation of the reactor. (This mode of operation is feasible also when a single jar 10 is comprised in the reactor by means of a suitable control of the valves 12A and 12B.) Furthermore it is possible to treat the substances only in a few of the chambers of a multiple jar 80, for example treating a first pair of substances α and β in chambers 90 and 91, connected in series and simultaneously treating a second pair of substances λ, and μ in chambers 92 and 93. In this case the second port 114 of the chamber 91 is connected via a tubular fitting 115 to a storage container of the product resulting from the treatment of substances α and β while the second port 109 of the chamber 93 is connected to a storage container of the product resulting from the treatment of substances λ, and μ. It is understood that also other series-parallel operations of the multiple jar 80 are feasible through a proper control of the described tubular fittings and the associated valves.

The mechano-chemical treatments of the substances by the reactor can be controlled either manually or automatically on the base of inputs supplied by sensing means or other monitoring systems of the temperature and pressure conditions in the chambers of the multiple jar 80 in order to act on the heating and/or cooling fluid circulated in the hollow spaces 94, 95 as well as on the state of the valve means associated to the jar.

In order to emphasize the definitely high productivity of the above described first embodiment of the invention, the following table compares the characteristics of a prototype reactor according to the present invention (in the variant comprising a multiple jar 80 according to FIGS. 5 to 7) and a high energy mill implementing the previously cited EP-A-0 665 770, which is deemed as the closest prior art.

TABLE 1

| Characteristics | Present invention | State of the art |
|---|---|---|
| Oscillating mass | 484 kg | 50 kg |
| Oscillation frequency | 15 Hz | 15 Hz |
| Oscillation amplitude | 30 mm | 30 mm |
| Power of driving motor | 11 kW | 2 kW |
| Max acceleration (@ 15 Hz) | 133 $m/s^2$ | 105 $m/s^2$ |
| Inertial forces (@ 15 Hz) | 64.4 kN | 5.25 kN |
| Typical batch to be treated | 2 $dm^3$ | 0.20 $dm^3$ |

A second embodiment of the present invention is now described with reference to FIGS. 8 to 11. The embodiment is particularly suitable when the oscillating mass of the reactor exceeds 700 kg, while also in this case the oscillation frequency is above 10 Hz, preferably 15 Hz, and the oscillation amplitude is above 20 mm, preferably 30 mm. The big inertial forces generated by the oscillating mass (which is subdivided into two parts called functional units, as explained here below) need a construction of the reactor such that, in addition to the already mentioned basic features of the invention, it also adds the a dynamic compensation to the compensation due to the elastic system so as to attain a majority overall share of the compensation of the inertial forces (at least 70%).

Figure 8:
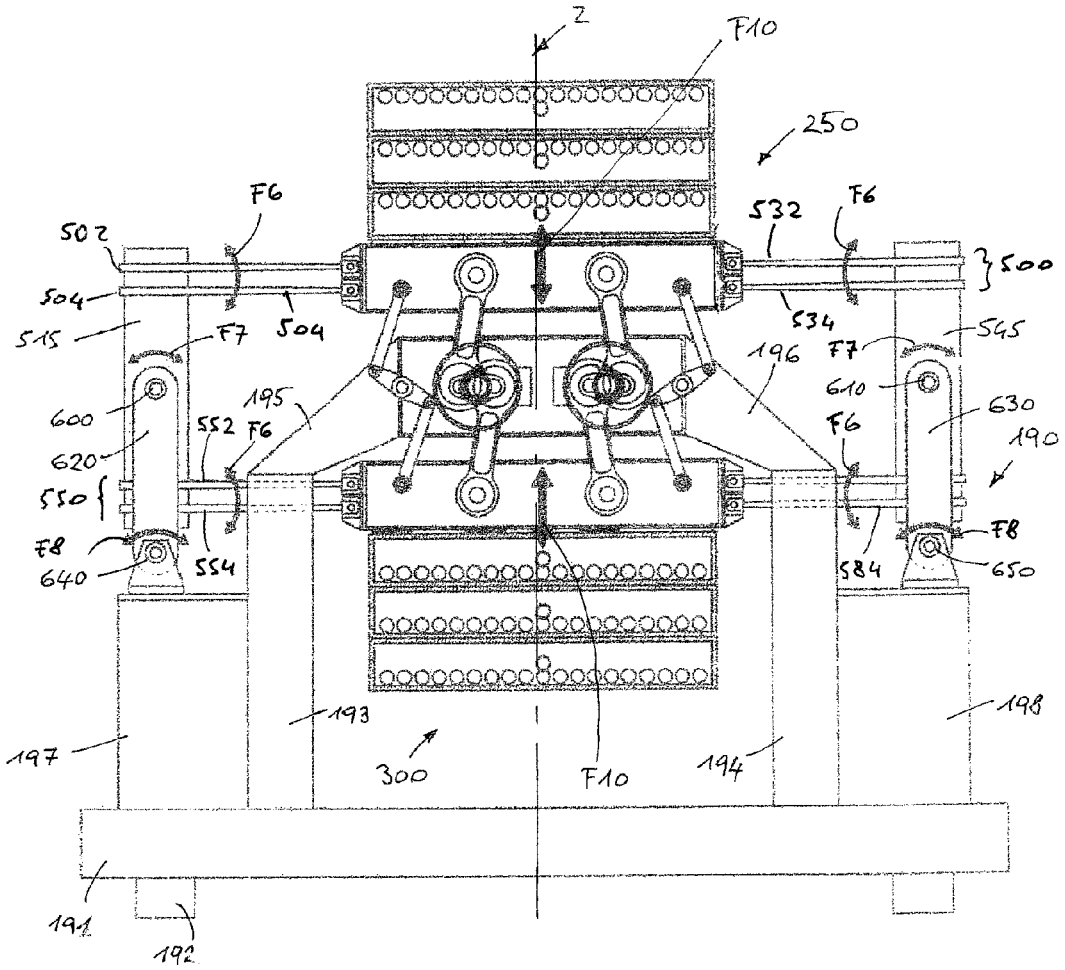
FIG. 8 is a front view, partially in transparency, of a second embodiment comprising a plurality of milling jars comprised in a pair of functional units.

In this embodiment the structural frame comprises the following parts, as can be seen in FIG. 8:

- a pedestal 191 resting onto the floor by means of adjustable feet 192;
- two pairs of pillars, each pair being formed by lower vertical portions 193, 194 welded onto the pedestal 191 and by upper converging portions 195, 196 to firmly sustain a horizontal parallelepiped box 290 housing the driving means of the reactor;
- two vertical and parallelepiped rigid blocks 197, 198 which are welded onto the pedestal 191 externally to the pillars, the height of these blocks being lower than the height of the vertical portions 193, 194 of the pillars—see FIG. 8. Bearings 640 and 650, associated to pins provided in the lower end of tilting arms 620 and 630, are fixed to the summit of blocks 197 and 198. In the upper end of tilting arms 620 and 630 are provided the fulcra 600 and 610 of corresponding supports in the form of columns 515 and 545 which are connected to the elastic system of the reactor, as clarified here below.

Figure 9:
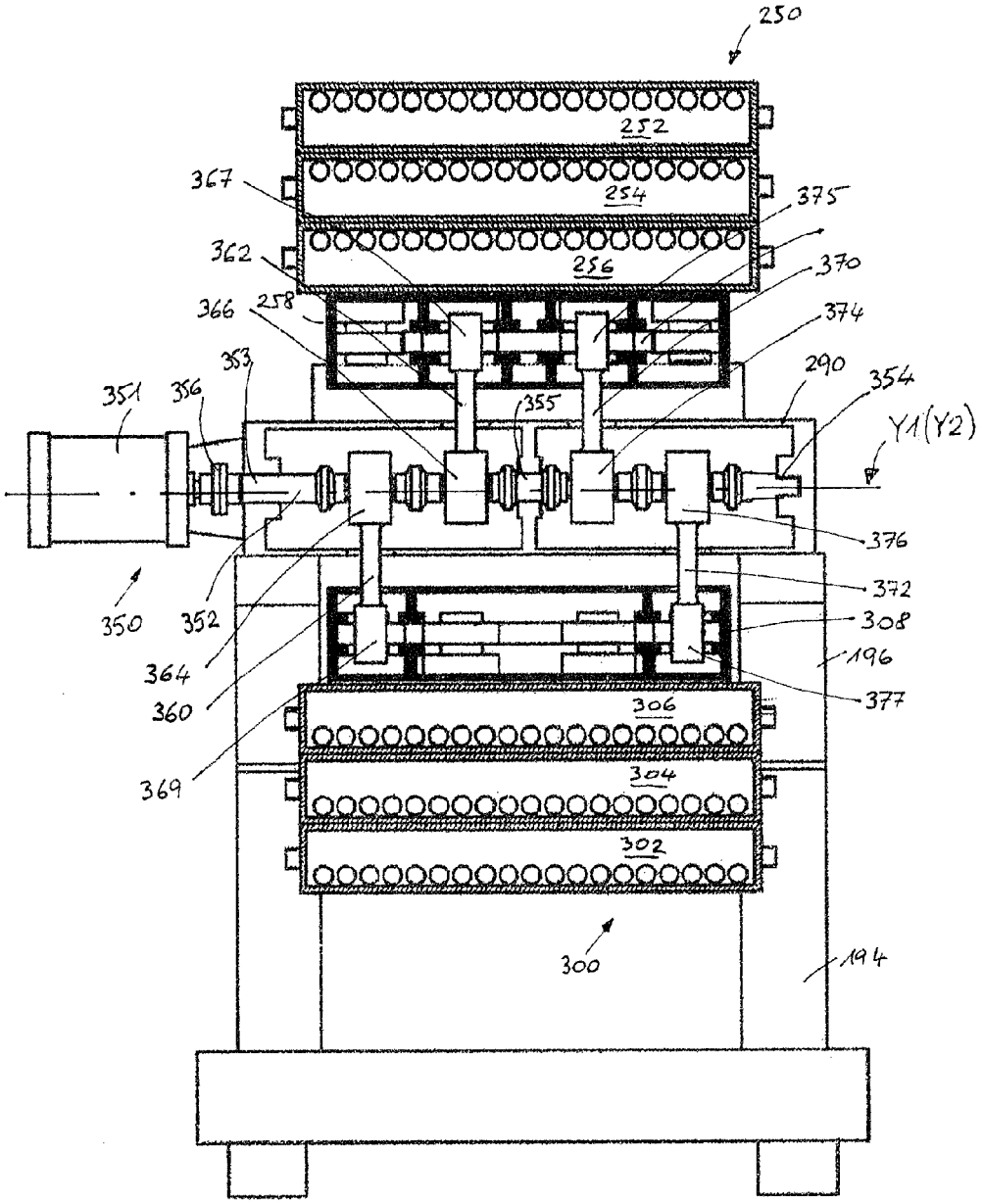
FIG. 9 is a transversal view, partially looked through, of the second embodiment.

The driving means of the present embodiment consist in a pair of driving units 350 and 400, identical one another. For simplicity the first driving unit is described in detail since the construction of their components are illustrated in FIGS. 8 and 9 while the reference numerals of the corresponding most important components of the second driving units are written into brackets when they are illustrated in the schematic representation of FIG. 11.

The first driving unit 350 (400) comprises a hydraulic motor 351 (401) for the actuation, through an elastic joint 356, a crankshaft 352 (402) extended along a horizontal axis Y1 (Y2) and housed in the parallelepiped box 290, where it is supported by two end bearings 353, 354 and by a central bearing 355. As above mentioned the box 290 is firmly sustained by the upper converging portions 195, 196 of the pillars making part of the structural frame of the reactor. It is noteworthy that the axis Y1 and Y2 of the crankshafts 352 and 402 are parallel and define horizontal plane.

On the cranks of the crankshafts 352 (402) which are closer to the motor 351 (401) are mounted the big ends 364 (414) and 366 (416) of a first pair of opposed rods 360 (410) and 362 (412) while on the cranks beyond the central bearings are mounted the big ends 374 (424) and 376 (426) of a second pair of opposed rods 370 (420) and 372 (422). From associated slots provided at the upper face of box 290 are protruding the small end 367 (417) and a portion of the stem of the rod 362 (412) as well as the small end 375 (425) and a portion of the stem of the rod 370 (420) of said first pair of opposed rods. In a similar manner from associated slots provided at the lower face of box 290 are protruding the small end 369 (419) and a portion of the stem of the other rod 360 (410) as well as the small end 377 (427) and a portion of the stelo of the other rod 372 (422) of said second pair of opposed rods.

The oscillating mass is now described which, as above mentioned, is subdivided into two functional units 250 and 300. In FIG. 8 the double arrows F10 define the reciprocating movements to which the functional units 250 are subjected by the driving units 350 and 400—in the direction of the vertical axis Z of the reactor—with the peculiarities described here below.

The functional unit 250 is positioned below the box 290, namely above the horizontal plane defined by the axis Y1 and Y2 of the crankshaft 352 and 452 of the driving means, thus functional unit 250 is called upper functional unit. The functional unit 300 is positioned below the box 290, namely below the said horizontal plane, thus the functional unit 300 is called lower functional unit.

Units 250 and 300 are formed of the same parts though in a different arrangement as it can be appreciated in FIGS. 8 and 9. For simplicity the following description refers to the upper functional unit 250 and the variants of the lower functional unit 300 with their reference numerals are written into brackets.

Unit 250 (300) comprises a set of three milling jars superimposed one another and bearing top down with reference numerals 252 (306), 254 (304), 256 (302). These are single jars like those above described of the first embodiment and each jar is a restricted environment loaded with the solid and/or liquid to be treated and the balls or other milling bodies 89.

In each set the jars are constrained each other by clamps (not shown) which also ensure the fastening of the set to a parallelepiped box 258 (308) which is provided with slots at one of their horizontal faces lying perpendicular to axis Z. In the box are housed a first and a second axle 260 (310) and 262 (312) extended along the axes Y3 (Y5) and Y4 (Y6) which are parallel to the axis Y1 and Y2 of crankshafts 352 and 402 respectively and define a horizontal plane.

In the upper functional unit 250 the box 258 is fixed at the bottom of the set of jars 252, 254, 256 which means that the said slots are provided at the lower face of the box 258, facing the box 290 where the crankshafts 352 and 402 are housed. In the lower functional unit 300 the box 308 is fixed at the top of the set of jars 306, 304, 302 which means that the said slots are provided at the upper face of the box 258, facing the box 290 where the crankshafts 352 and 402 are housed. This is the different arrangement of the parts in the two functional units which has been already mentioned here above.

Figure 11:
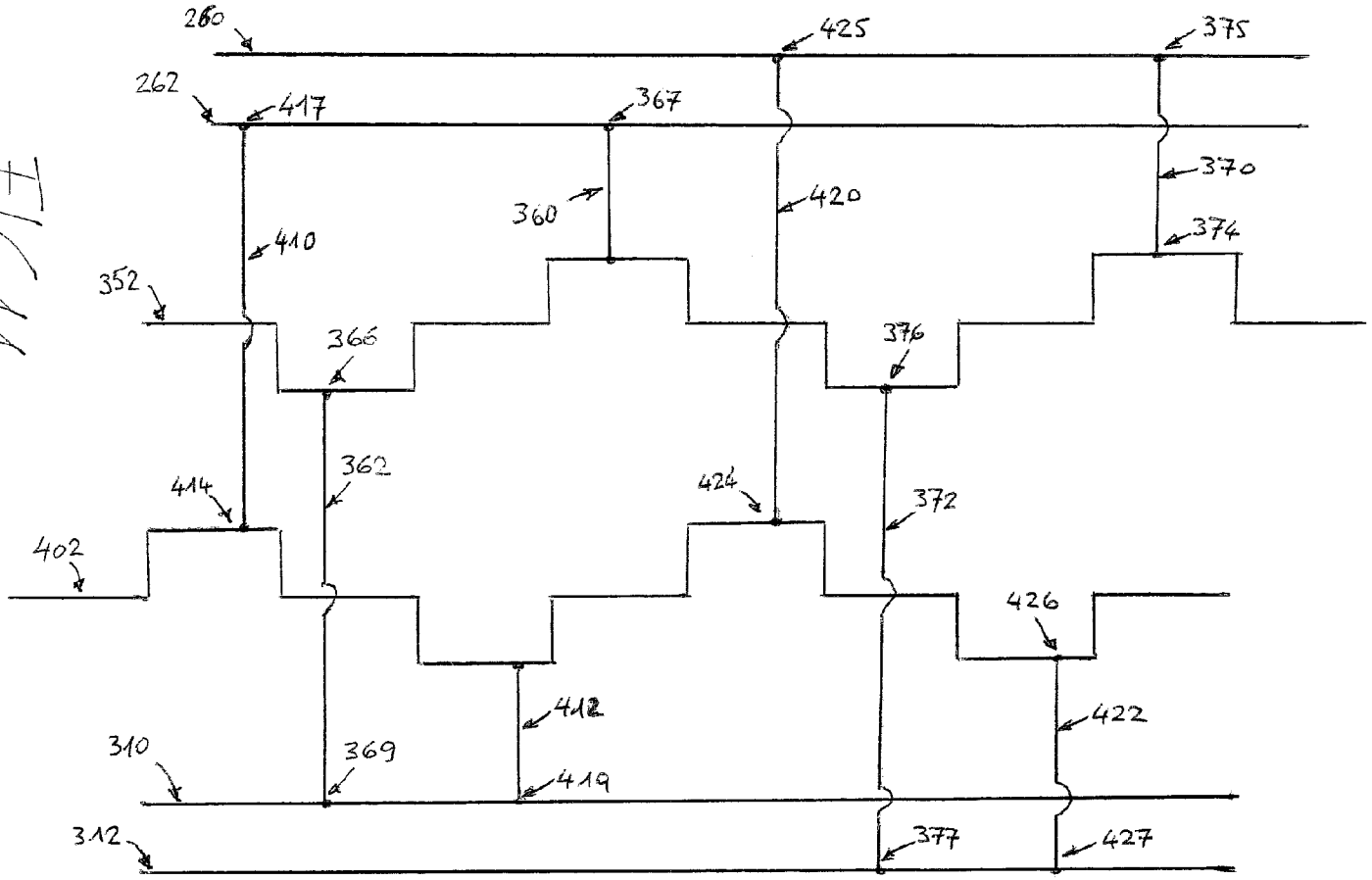
FIG. 11 shows a schematic view of the architecture of the connection means which are arranged between the driving means and the functional units in the reactor shown in FIGS. 8 to 10.

FIG. 11 shows in a schematic form the connections between the driving means and the oscillating mass in this embodiment of the reactor, then it also contains the reference numerals of some parts which are not seen in FIGS. 8 and 9. According to a main feature of the invention which is claimed here below, in this embodiment the architecture of the said connections provides a dynamical compensation of a share of the inertial forces generated by the reciprocating movements of the oscillating mass which supplements the share of compensation provided by the elastic system to be described.

At first, let us consider the connections involving the first driving unit 350 or, more precisely, the crankshaft thereof 352.

The small end 367 of a rod 360 belonging to the first pair of opposed rods (namely those which are close to the motor 351) is mounted onto the second axle 262 in the box 258 of the upper functional unit 250 while the small end 369 of the second rod 362 in the same pair of rods is mounted onto the first axle 310 in the box 308 of the lower functional unit 300.

The small end 375 of a rod 370 belonging to the second pair of opposed rods (namely those which distant from the motor 351) is mounted onto the first axle 260 in the box 258 of the upper functional unit 250 while the small end 377 of the second rod 372 in the same pair of rods is mounted onto the second axle 312 in the box 308 of the lower functional unit 300.

As regards the connections involving the second driving unit 400 or, more precisely, the crankshaft thereof 402, the small end 417 of a rod 410 belonging to the first pair of opposed rods (namely those which are close to the motor 401) is mounted onto the second axle 262 in the box 258 of the upper functional unit 250 while the small end 419 of the second rod 412 in the same pair of rods is mounted onto the first axle 310 in the box 308 of the lower functional unit 300.

The small end 425 of a rod 420 belonging to the second pair of opposed rods (namely those which distant from the motor 401) is mounted onto the first axle 260 in the box 258 of the upper functional unit 250 while the small end 427 of the second rod 422 in the same pair of rods is mounted onto the second axle 312 in the box 308 of the lower functional unit 300.

To sum up, the second embodiment of the opposed two by two, being mounted onto each crankshaft and ensuring the connections with the two sets of milling jars of which the oscillating mass is formed. Thence, the two sets of milling jars are simultaneously subjected by both crankshafts to reciprocating movements in counterphase along the same vertical axis Z by means of the opposed rods.

As in the first embodiment the expressions vertical axis of the reciprocating movements and perpendicularity between said axes and the axes of the driving means shall be understood with some tolerance, indicatively in the order of 5 mm.

As above anticipated, it is the described architecture of the connections that contributes, in a dynamic form, to the compensation of the inertial forces generated by the oscillating mass.

In order to ensure that the reciprocating movements take place simultaneously and in counterphase, two systems are provided in the reactor.

The first system (not illustrated in the drawings for simplicity and also for the reason it can be easily realized by a person skilled in the art) acts directly on the driving means and consists of four synchronizing gears. One gear is keyed on each crankshaft 352, 402 while the remaining two gears are in mesh with one another.

The second system comprises four identical articulated parallelograms. For simplicity the following description refers to the parallelogram 480 which is shown in FIG. 8 and is one of the two parallelograms positioned on the front side of the reactor.

Parallelogram 480 comprises a lever 482 having a central fulcrum 484 positioned onto the box 290 housing the crankshafts 352 and 402 of the driving units 350 and 400. At the ends 481 and 483 of the lever 480 are hinged the first ends of respective arms 486 and 488. Arm 486 has its second end 487 hinged onto the box 258 comprised in the first functional unit 250 while arm 488 has its second end 489 hinged onto the box 308 comprised in the second functional unit 300.

Also in the second embodiment an important share of the inertial forces generated by the reciprocating movements of the oscillating mass is compensated by an elastic system comprising one dimensional or two dimensional flexible elements.

Figure 10:
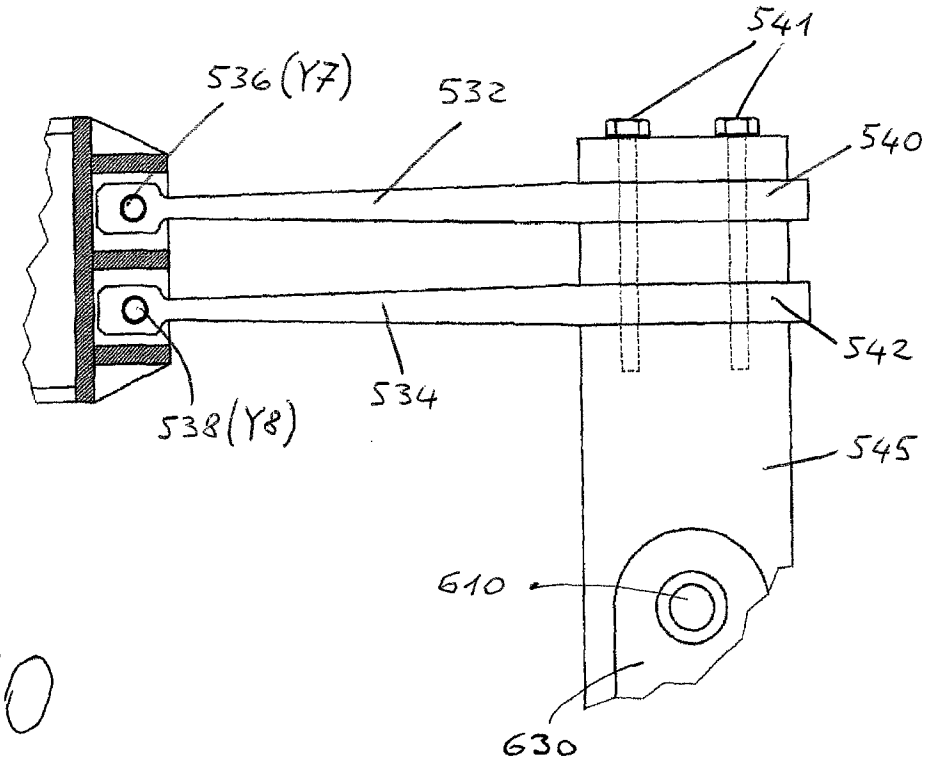
FIG. 10 shows partially looked through and in an enlarged scale some details of the flexible elements comprised in the elastic system of the reactor shown in FIGS. 8 to 9.

In the example illustrated in FIGS. 8 to 10 the said flexible elements are again a plurality of bars made with the alloy $Ti_6Al_4V$ and subdivided in the same number on the two functional units of the which the oscillating mass is formed. For this reason in the following are described un upper elastic subsystem 500 and a lower elastic system 550 which are identical to one another.

Each elastic subsystem comprises four pairs of flexible rectilinear bars which, when the reactor is in rest conditions, are extended substantially perpendicular to the direction of the oscillations (reciprocating movements) of the functional units 250 and 300, namely substantially perpendicular to axis Z. Of the said four pairs of rods only two are shown in FIG. 8, namely those designated with reference numerals 502, 504 and 532, 534 which belong to the upper elastic subsystem 500 and are positioned at the right side and at the left side of axis Z, respectively. In FIG. 8 are also shown two of the four pairs of rods designated with reference numerals 552, 554 and 582, 584 which belong to the lower elastic subsystem 550 and are positioned at the right side and at the left side of axis Z, respectively.

In consideration that all flexible bars are identical and that in each pair the bars are vertically spaced from one another, the following detailed description is uniquely referred to FIG. 10 where are shown on an enlarged scale the pair of bars 532, 534. In each bar two spaced apart zones are defined corresponding to the proximal ends and the distal ends of the same flexible bars, respectively.

At the proximal ends thereof hinging means 536, 538 are provided for the connection of flexible bars 532, 534 to the box 258 making part of the upper functional unit 250 of the oscillating mass. The axes Y7, Y8 of hinging means 536, 538 are perpendicular to axis Z of the reciprocating movements of the oscillating mass, that is horizontal.

On the contrary the distal ends 540, 542 of the same flexible bars 532, 534 are fixed by means of stud bolts rigidly, namely are rigidly fastened, to an upper portion of the support in the form of a column 545 which makes part of the structural frame of the reactor, at the right side of the vertical axis Z.

This construction is the same as regards the pair of flexible bars 582, 584 belonging to the lower elastic subsystem, also at the right side of the vertical axis Z of the reciprocating movements of the oscillating mass, with the difference that the proximal ends of the bars 582, 584 are connected through hinging means to the box 308 making part of the lower functional unit 300 of the oscillating mass and the distal ends are fixed by means of stud bolts, namely are rigidly fastened, to a lower portion of the support in the form of a column 545 which makes part of the structural frame of the reactor.

Totally in symmetry with the above description, the flexible bars disposed in the reactor at the left side of the axis Z of the reciprocating movements of the oscillating mass are connected at their proximal ends by hinging mean to the box 258 of the functional unit 250 and are fixed by means of stud bolts to the support in the form of a column 541 which makes part of the structural frame.

As a completion of the description of the second embodiment, the following details are added with reference to FIG. 9:

- the double arrows F6 mean the alternate bendings of the elastic subsystem 500 and 550 providing the compensation of share of the inertial forces generated by the reciprocating movements of the oscillating mass along the direction of vertical axis Z;
- the double arrows F7 mean the oscillations of the supports 541, 545 in the form of a column 541 about the fulcra 600, 610 ensuring the connection to the arms 620, 630 respectively, and
- the double arrows F8 mean the tilting movements of the said arms 620, 630 about the bearings 640, 650. The tilting movements compensate the mutual approach of the distal ends of the flexible elements of the two elastic subsystems 500, 550 due to their bendings when the reactor is in operation.

In the following Table 2 are the characteristics, referred to the discontinuous mode of operation, of a prototype mechano-chemical reactor in accordance with the second embodiment of the present invention.

TABLE 2

| Characteristics of the present invention | |
|---|---|
| Overall oscillating mass (two functional units) | 4000 kg |
| Oscillation frequency | 15 Hz |
| Oscillation amplitude | 30 mm |
| Power of driving motor | 60 kW |
| Max acceleration (@ 15 Hz) | 133 $m/s^2$ |
| Inertial forces (@ 15 Hz) | 490.4 kN |
| Typical batch to be treated | 20 $dm^3$ |

Without coming out of the field of protection ensured by the appended claims, on the base of the teachings given in the preceding description at least the following variants of the second embodiment of the reactor are deemed as feasible:

- in the functional units of the oscillating mass the use of a number of single milling jars superimposed one another other than three in each set of jars;
- in the functional units of the oscillating mass the use of a pair of multiple jars, as illustrated in FIGS. 5 to 7, even with a number of chambers other than four in each multiple jar instead of two sets of single milling jars;
- in the elastic system the use of polygonal flexible plates, namely two dimensional flexible elements, preferably made with titanium alloys, instead of the pairs of bars (one dimensional flexible elements). In this case each plate has two parallel sides, of which a first side is connected to the boxes of the functional units through hinging means and the second side is fixed through rigid fastening means to the columns comprised in the structural frame of the reactor;

driving means consisting of a single unit, namely comprising one motor, one crankshaft and the opposed rods connected to the functional units in such a way to ensure their reciprocating movements are in counterphase;

just one mechanical system, instead of two, to ensure that the said reciprocating movements are synchronous or, alternatively, an electronic phasing system of the motors;

the use of sensing means (e.g. accelerometers) to ensure that the conditions of oscillation (frequency and amplitude) are optimal in terms of mechanics and energy consumption.

The invention claimed is:

1. A mechano-chemical reactor comprising:

a load-bearing structure (40; 190) formed by several members;

driving means (30; 350, 400) extended along one or more parallel axis (X; Y1, Y2);

a mass suitable to be subjected by the driving means to an alternate motion, namely a mass oscillating substantially along the direction of a vertical axis (Z) and comprising at least one restricted environment where substances in a solid and/or liquid state receive a physical or chemical-physical treatment by kinetic energy of milling bodies (14; 89);

an elastic system for the compensation of a share of the inertial forces generated by the oscillations of said mass, characterized in that said elastic system comprises one or more one-dimensional (52; 502, 504, 532, 534, 552, 554, 582, 584), or alternatively bi-dimensional, flexible elements made of a titanium alloy which in rest conditions are extended substantially perpendicular to the direction of the oscillations and ensure the connection of the oscillating mass to the load-bearing structure, where the said flexible elements when they are one-dimensional, comprise a plurality of rectilinear parallel rods (52) or alternatively, when they are bidimensional, comprise at least one polygonal plate having two sides parallel to the axis of the driving means.

2. A reactor according to claim 1, characterized in that the oscillations of the mass have a frequency above 10 Hz, and an amplitude above 20 mm.

3. A reactor according to claim 2, characterized in that the oscillations of the mass have a frequency of 15 Hz.

4. A reactor according to claim 3, characterized in that the oscillations of the mass have an amplitude of 30 mm.

5. A reactor according to claim 1, characterized in that hinging means (72, 76; 536, 538), the axes of which are substantially perpendicular to the direction of the oscillations, are provided in at least one of two spaced-apart zones of said flexible elements for the connection to the oscillating mass or, alternatively, to the load-bearing structure.

6. A reactor according to claim 5, characterized in that when the hinging means are provided in only one of the said zones, rigid fastening means are provided in the second zone thereof for the connection of the flexible elements to the load-bearing structure, or alternatively to the oscillating mass.

7. A reactor according to claim 1, characterized in that the said oscillating mass comprises a single restricted environment consisting of a milling jar having an axis coincident with the direction of the oscillations, the jar being provided with ports for feeding (12A) the substances to be treated and ports for discharging (12B) the products obtained from the treatment, and in that stop valves are arranged at all of the said ports.

8. A reactor according to claim 1, characterized in that said oscillating mass comprises:

a plurality of restricted environments (90, 91, 92, 93) inside a milling jar (80) having an axis coincident with the direction of the oscillations;

pipe fittings (102, 108, 112, 115, 118) arranged between ports for feeding (101, 113, 116, 119) the substances to be treated and ports for discharging (109, 111, 114, 117) the products obtained from the treatment;

valve means in said pipe fittings able to be arranged in various dispositions in order to obtain various series and/or parallel functionalities of the reactor including a continuous operation.

9. A reactor according to claim 1, characterized in that:

the oscillating mass is of between 200 and 700 kg and comprises at least one milling jar (10);

the driving means (30) of the mass are extended along the direction of a single axis (X);

the share of the inertial forces compensated by said one-dimensional or bi-dimensional flexible elements is at least 70%, the residual share being discharged onto the load bearing structure;

the central zone of said bars (52), or alternatively, the central zone of the said at least one plate, are rigidly fastened to an enlarged base of the jar;

first hinging means (71) ensure a direct connection of an end zone of the bars, or alternatively of one of the parallel sides of the polygonal plate, to first members (45B) of the load bearing structure;

second hinging means (73) ensure, by means of tilting arms (78), an indirect connection of the other end zone of the bars, or alternatively of the other of the parallel sides of the at least one polygonal plate, to second members (45A) of the load bearing structure.

10. A reactor according to claim 1, characterized in that:

the driving means comprise at least one crankshaft (352, 402) extended along the direction of a horizontal axis (Y1, Y2) where are mounted the connecting ends (364, 366, 374, 376 and 414, 416, 424, 426) of at least two pairs of opposed rods (360, 362, 370, 372 and 410, 412, 420, 422);

the oscillating mass is over 700 kg and is subdivided into two functional units (250, 300) which are made of the same parts but arranged symmetrically with respect to the axis of the at least one crankshaft;

the functional units, each of which comprises at least one restricted environments, are connected to the driving means in such a manner that their oscillations take place in counterphase;

in the said elastic system for the compensation of a share of the inertial forces, the flexible elements comprise at least a pair of rectilinear bars (502 and 504, 532 and 534, 552 and 554, 582 and 584), when one-dimensional, or alternatively at least one polygonal plate having two parallel sides, when bi-dimensional;

in each one of the flexible elements are defined:

a first zone corresponding to the proximal ends of the bars, or alternatively corresponding to a central portion of the said plate with respect to its parallel sides, and a second zone corresponding to the distal ends (510 and 512, 540 and 52; 560 and 562, 590 and 592) of the bars, or alternatively corresponding to the parallel sides of the plate;

in the first zone the flexible elements are connected to each one of the functional units by separate hinging means (506 and 508, 536 and 538; 556 and 558, 586 and 588) having their axis parallel to the axis of the at least one crankshaft;

in their second end the same flexible elements are connected to separate tilting members (515, 545) of the load bearing structure by rigid fastening means (541);

the total share of compensation of the inertial forces is at least 70% considering the elastic compensation by the flexible elements and additionally the dynamic compensation deriving by the oscillations in counterphase of the two functional units.

11. A reactor according to claim 10, characterized in that the driving means are subdivided into two groups (350, 400), each group being connected by said rods to both functional units and in that at least one hardware and/or software device links the said groups with one another so as to ensure that the oscillations of the functional units take place not only in counterphase but also synchronously.

12. A reactor according to claim 11, characterized in that the said hardware device is at least one of the following:

a set of four gears, of which two are identical with one another and keyed onto the crankshaft of each group and two are also identical with one another and are in mesh;

at least one articulated parallelogram (480, 490) consisting of a lever (482) having a central fulcrum onto a box (290) where the crankshafts (352, 402) of the two driving groups are accommodated, and consisting also of two tilting arms (486) having a first end (481, 483) hinged onto said lever and the second end hinged onto one of the functional units.

13. A reactor according to any of the preceding claims, characterized in that it comprises sensor means of vibrations for monitoring the frequency and amplitude of the oscillations of the oscillating mass and sensor means for controlling the physical parameters in the restricted environments during the operation of the reactor.

14. A reactor according to claim 13, characterized in that the sensor means of vibrations are accelerometers.

15. A reactor according to claim 14, characterized in that the sensor means for controlling the physical parameters are for sensing temperature and pressure.

* * * * *